US007451809B2

(12) United States Patent
Noske et al.

(10) Patent No.: US 7,451,809 B2
(45) Date of Patent: Nov. 18, 2008

(54) APPARATUS AND METHODS FOR UTILIZING A DOWNHOLE DEPLOYMENT VALVE

(75) Inventors: Joe Noske, Houston, TX (US); David J. Brunnert, Cypress, TX (US); David Pavel, Kingwood, TX (US); Ramkumar K. Bansal, Houston, TX (US); David Haugen, League City, TX (US); Mike A. Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 214 days.

(21) Appl. No.: 11/157,512

(22) Filed: Jun. 21, 2005

(65) Prior Publication Data

US 2005/0230118 A1 Oct. 20, 2005

Related U.S. Application Data

(63) Continuation-in-part of application No. 10/270,015, filed on Oct. 11, 2002, now Pat. No. 7,086,481, and a continuation-in-part of application No. 10/288,229, filed on Nov. 5, 2002, now Pat. No. 7,350,590, and a continuation-in-part of application No. 10/783,982, filed on Feb. 20, 2004, now Pat. No. 7,178,600, which is a continuation-in-part of application No. 10/677,135, filed on Oct. 1, 2003, now Pat. No. 7,255,173, and a continuation-in-part of application No. 10/676,376, filed on Oct. 1, 2003, now Pat. No. 7,219,729.

(60) Provisional application No. 60/485,816, filed on Jul. 9, 2003.

(51) Int. Cl.
*E21B 34/12* (2006.01)

(52) U.S. Cl. ..... 166/66; 166/250.01; 166/373; 166/332.8

(58) Field of Classification Search ..... 166/66, 166/65.1, 250.01, 66.6, 332.8, 40, 373; 340/853.3; 175/40

See application file for complete search history.

(56) References Cited

U.S. PATENT DOCUMENTS 2,898,008 A 8/1959 Alder (Continued)

FOREIGN PATENT DOCUMENTS

EP 0 945 590 9/1999

(Continued)

OTHER PUBLICATIONS

Downhole Deployment Valve Bulletin, Weatherford International Ltd., (online) Jan. 2003. Available from http://www.weatherford.com/weatherford/groups/public/documents/general/wft004406.pdf.

(Continued)

*Primary Examiner*—Kenneth Thompson
(74) *Attorney, Agent, or Firm*—Patterson & Sheridan, L.L.P.

(57) ABSTRACT

Methods and apparatus for utilizing a downhole deployment valve (DDV) to isolate a pressure in a portion of a bore are disclosed. The DDV system can include fail safe features such as selectively extendable attenuation members for decreasing a falling object's impact, a normally open back-up valve member for actuation upon failure of a primary valve member, or a locking member to lock a valve member closed and enable disposal of a shock attenuating material on the valve member. Actuation of the DDV system can be electrically operated and can be self contained to operate automatically downhole without requiring control lines to the surface. Additionally, the actuation of the DDV can be based on a pressure supplied to an annulus.

36 Claims, 12 Drawing Sheets

U.S. PATENT DOCUMENTS

| | | | | | |
|---|---|---|---|---|---|
| 3,148,731 | A | | 9/1964 | Holden | |
| 3,831,138 | A | | 8/1974 | Rammner | |
| 3,986,350 | A | | 10/1976 | Schmidt | |
| 4,015,234 | A | | 3/1977 | Krebs | |
| 4,160,970 | A | | 7/1979 | Nicolson | |
| 4,276,931 | A | | 7/1981 | Murray | |
| 4,367,794 | A | | 1/1983 | Bednar et al. | |
| 4,440,231 | A | | 4/1984 | Martin | |
| 4,553,428 | A | | 11/1985 | Upchurch | |
| 4,617,960 | A | * | 10/1986 | More | 137/544 |
| 4,691,203 | A | | 9/1987 | Rubin et al. | |
| 4,709,900 | A | | 12/1987 | Dyhr | |
| 4,739,325 | A | | 4/1988 | MacLeod | |
| 4,775,009 | A | | 10/1988 | Wittrisch et al. | |
| 5,172,717 | A | | 12/1992 | Boyle et al. | |
| 5,235,285 | A | | 8/1993 | Clark et al. | |
| 5,293,551 | A | | 3/1994 | Perkins et al. | |
| 5,299,640 | A | * | 4/1994 | Streich et al. | 166/327 |
| 5,303,773 | A | | 4/1994 | Czernichow et al. | |
| 5,355,952 | A | | 10/1994 | Meynier | |
| 5,358,035 | A | * | 10/1994 | Grudzinski | 166/53 |
| 5,512,889 | A | | 4/1996 | Fletcher | |
| 5,564,502 | A | | 10/1996 | Crow et al. | |
| 5,706,892 | A | * | 1/1998 | Aeschbacher et al. | 166/66 |
| 5,730,219 | A | | 3/1998 | Tubel et al. | |
| 5,868,201 | A | * | 2/1999 | Bussear et al. | 166/53 |
| 5,892,860 | A | | 4/1999 | Maron et al. | |
| 5,992,519 | A | | 11/1999 | Ramakrishnan et al. | |
| 5,996,687 | A | | 12/1999 | Pringle et al. | |
| 6,006,828 | A | | 12/1999 | Kluth et al. | |
| 6,006,832 | A | | 12/1999 | Tubel et al. | |
| 6,018,501 | A | | 1/2000 | Smith et al. | |
| 6,041,864 | A | | 3/2000 | Patel et al. | |
| 6,072,567 | A | | 6/2000 | Sapack | |
| 6,075,462 | A | | 6/2000 | Smith | |
| 6,095,250 | A | | 8/2000 | Day et al. | |
| 6,138,754 | A | * | 10/2000 | Veneruso et al. | 166/250.03 |
| 6,173,772 | B1 | | 1/2001 | Vaynshteyn | |
| 6,176,312 | B1 | | 1/2001 | Tubel et al. | |
| 6,191,586 | B1 | | 2/2001 | Bittar | |
| 6,199,629 | B1 | | 3/2001 | Shirk et al. | |
| 6,209,663 | B1 | | 4/2001 | Hosie | |
| 6,253,843 | B1 | * | 7/2001 | Rawson et al. | 166/66.7 |
| 6,279,660 | B1 | | 8/2001 | Hay | |
| 6,283,207 | B1 | | 9/2001 | Lemetayer | |
| 6,286,595 | B1 | * | 9/2001 | Oxnevad et al. | 166/242.7 |
| 6,308,137 | B1 | | 10/2001 | Underhill et al. | |
| 6,325,146 | B1 | | 12/2001 | Ringgenberg et al. | |
| 6,354,147 | B1 | | 3/2002 | Gysling et al. | |
| 6,378,612 | B1 | | 4/2002 | Churchill | |
| 6,422,084 | B1 | | 7/2002 | Fernald et al. | |
| 6,425,444 | B1 | | 7/2002 | Metcalfe et al. | |
| 6,427,776 | B1 | | 8/2002 | Hoffman et al. | |
| 6,478,091 | B1 | | 11/2002 | Gano | |
| 6,531,694 | B2 | | 3/2003 | Tubel et al. | |
| 6,585,041 | B2 | | 7/2003 | Crossley | |
| 6,598,675 | B2 | | 7/2003 | Bussear et al. | |
| 6,619,388 | B2 | * | 9/2003 | Dietz et al. | 166/66.7 |
| 6,684,950 | B2 | | 2/2004 | Patel | |
| 6,802,373 | B2 | | 10/2004 | Dillenbeck et al. | |
| 6,820,697 | B1 | | 11/2004 | Churchill | |
| 6,957,703 | B2 | * | 10/2005 | Trott et al. | 166/332.8 |
| 6,988,556 | B2 | | 1/2006 | Vick, Jr. | |
| 7,086,481 | B2 | | 8/2006 | Hosie et al. | |
| 2003/0066650 | A1 | | 4/2003 | Fontana et al. | |
| 2003/0150621 | A1 | | 8/2003 | Pia | |
| 2004/0065446 | A1 | | 4/2004 | Tran et al. | |
| 2004/0084189 | A1 | | 5/2004 | Hosie et al. | |
| 2004/0129424 | A1 | | 7/2004 | Hosie et al. | |
| 2004/0139791 | A1 | | 7/2004 | Johansen | |
| 2004/0251032 | A1 | | 12/2004 | Luke et al. | |
| 2005/0056419 | A1 | | 3/2005 | Hosie et al. | |

FOREIGN PATENT DOCUMENTS

| | | |
|---|---|---|
| GB | 2 154 632 | 9/1985 |
| GB | 2 299 915 | 10/1996 |
| GB | 2 330 598 | 4/1999 |
| GB | 2 335 453 | 9/1999 |
| GB | 2 360 532 | 9/2001 |
| GB | 2 381 282 | 4/2003 |
| GB | 2 394 242 | 4/2004 |
| GB | 2 394 974 | 5/2004 |
| GB | 2 398 590 | 8/2004 |
| GB | 2 400 125 | 10/2004 |
| GB | 2 403 250 | 12/2004 |
| WO | WO 95/50681 | 11/1998 |
| WO | WO 03/048517 | 6/2003 |
| WO | WO 03/097987 | 11/2003 |

OTHER PUBLICATIONS

Nimir Field In Oman Proves The Downhole Deployment Valve A Vital Technological Key To Success, Weatherford International Ltd., (online) 2003. Available at http://www.weatherford.com/weatherford/groups/public/documents/general/wft004337.pdf.

GB Search Report, Application No. 0612016.6, Dated Oct. 18, 2006.

GB Search Report, Application No. GB0719025.9, dated Jan. 8, 2008.

* cited by examiner

APPARATUS AND METHODS FOR UTILIZING A DOWNHOLE DEPLOYMENT VALVE

CROSS-REFERENCE TO RELATED APPLICATIONS

This application is a continuation-in-part of U.S. patent application Ser. No. 10/270,015, filed Oct. 11, 2002 now U.S. Pat. No. 7,086,481; is a continuation-in-part of U.S. patent application Ser. No. 10/288,229, filed Nov. 5, 2002 now U.S. Pat. No. 7,350,590; and is a continuation-in-part of U.S. patent application Ser. No. 10/783,982, filed Feb. 20, 2004 now U.S. Pat. No. 7,178,600, which is a continuation in part of U.S. patent application Ser. No. 10/677,135, filed Oct. 1, 2003 now U.S. Pat. No. 7,255,173, and U.S. patent application Ser. No. 10/676,376, filed Oct. 1, 2003 now U.S. Pat. No. 7,219,729, and which claims benefit of U.S. Provisional Patent Application Ser. No. 60/485,816, filed Jul. 9, 2003, all herein incorporated by reference in their entirety.

BACKGROUND OF THE INVENTION

1. Field of the Invention

Embodiments of the invention generally relate to methods and apparatus for use in oil and gas wellbores. More particularly, the invention relates to methods and apparatus for utilizing deployment valves in wellbores.

2. Description of the Related Art

Oil and gas wells are typically initially formed by drilling a borehole in the earth to some predetermined depth adjacent a hydrocarbon-bearing formation. After the borehole is drilled to a certain depth, steel tubing or casing is typically inserted in the borehole to form a wellbore, and an annular area between the tubing and the earth is filled with cement. The tubing strengthens the borehole, and the cement helps to isolate areas of the wellbore during hydrocarbon production. Some wells include a tie-back arrangement where an inner tubing string located concentrically within an upper section of outer casing connects to a lower string of casing to provide a fluid path to the surface. Thus, the tie back creates an annular area between the inner tubing string and the outer casing that can be sealed.

Wells drilled in an "overbalanced" condition with the wellbore filled with fluid or mud preventing the inflow of hydrocarbons until the well is completed provide a safe way to operate since the overbalanced condition prevents blow outs and keeps the well controlled. Overbalanced wells may still include a blow out preventer in case of a pressure surge. Disadvantages of operating in the overbalanced condition include expense of the mud and damage to formations if the column of mud becomes so heavy that the mud enters the formations. Therefore, underbalanced or near underbalanced drilling may be employed to avoid problems of overbalanced drilling and encourage the inflow of hydrocarbons into the wellbore. In underbalanced drilling, any wellbore fluid such as nitrogen gas is at a pressure lower than the natural pressure of formation fluids. Since underbalanced well conditions can cause a blow out, underbalanced wells must be drilled through some type of pressure device such as a rotating drilling head at the surface of the well. The drilling head permits a tubular drill string to be rotated and lowered therethrough while retaining a pressure seal around the drill string.

A downhole deployment valve (DDV) located within the casing may be used to temporarily isolate a formation pressure below the DDV such that a tool string may be quickly and safely tripped into a portion of the wellbore above the DDV that is temporarily relieved to atmospheric pressure. An example of a DDV is described in U.S. Pat. No. 6,209,663, which is incorporated by reference herein in its entirety. The DDV allows the tool string to be tripped into the wellbore at a faster rate than snubbing the tool string in under pressure. Since the pressure above the DDV is relieved, the tool string can trip into the wellbore without wellbore pressure acting to push the tool string out. Further, the DDV permits insertion of a tool string into the wellbore that cannot otherwise be inserted due to the shape, diameter and/or length of the tool string.

Actuation systems for the DDV often require an expensive control line that may be difficult or impossible to land in a subsea wellhead. Alternatively, the drill string may mechanically activate the DDV. Hydraulic control lines require crush protection, present the potential for loss of hydraulic communication between the DDV and its surface control unit and can have entrapped air that prevents proper actuation. The prior actuation systems can be influenced by wellbore pressure fluxions or by friction from the drill string tripping in or out. Furthermore, the actuation system typically requires a physical tie to the surface where an operator that is subject to human error must be paid to monitor the control line pressures.

An object accidentally dropped onto the DDV that is closed during tripping of the tool string presents a potential dangerous condition. The object may be a complete bottom hole assembly (BHA), a drill pipe, a tool, etc. that free falls through the wellbore from the location where the object was dropped until hitting the DDV. Thus, the object may damage the DDV due to the weight and speed of the object upon reaching the DDV, thereby permitting the stored energy of the pressure below the DDV to bypass the DDV and either eject the dropped object from the wellbore or create a dangerous pressure increase or blow out at the surface. A failsafe operation in the event of a dropped object may be required to account for a significant amount of energy due to the large energy that can be generated by, for example, a 25,000 pound BHA falling 10,000 feet.

Increasing safety when utilizing the DDV permits an increase in the amount of formation pressure that operators can safely isolate below the DDV. Further, increased safety when utilizing the DDV may be necessary to comply with industry requirements or regulations.

Therefore, there exists a need for improved methods and apparatus for utilizing a DDV.

SUMMARY OF THE INVENTION

The invention generally relates to methods and apparatus for utilizing a downhole deployment valve (DDV) system to isolate a pressure in a portion of a bore. The DDV system can include fail safe features such as selectively extendable attenuation members for decreasing a falling object's impact, a normally open back-up valve member for actuation upon failure of a primary valve member, or a locking member to lock a valve member closed and enable disposal of a shock attenuating material on the valve member. Actuation of the DDV system can be electrically operated and can be self contained to operate automatically downhole without requiring control lines to the surface. Additionally, the actuation of the DDV can be based on a pressure supplied to an annulus.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally relates to methods and apparatus for utilizing a downhole deployment valve (DDV) in a wellbore. For some of the embodiments shown, the DDV may be any type of valve such as a flapper valve or ball valve. Additionally, any type of actuation mechanism may be used to operate the DDV for some of the embodiments shown.

Figure 1:
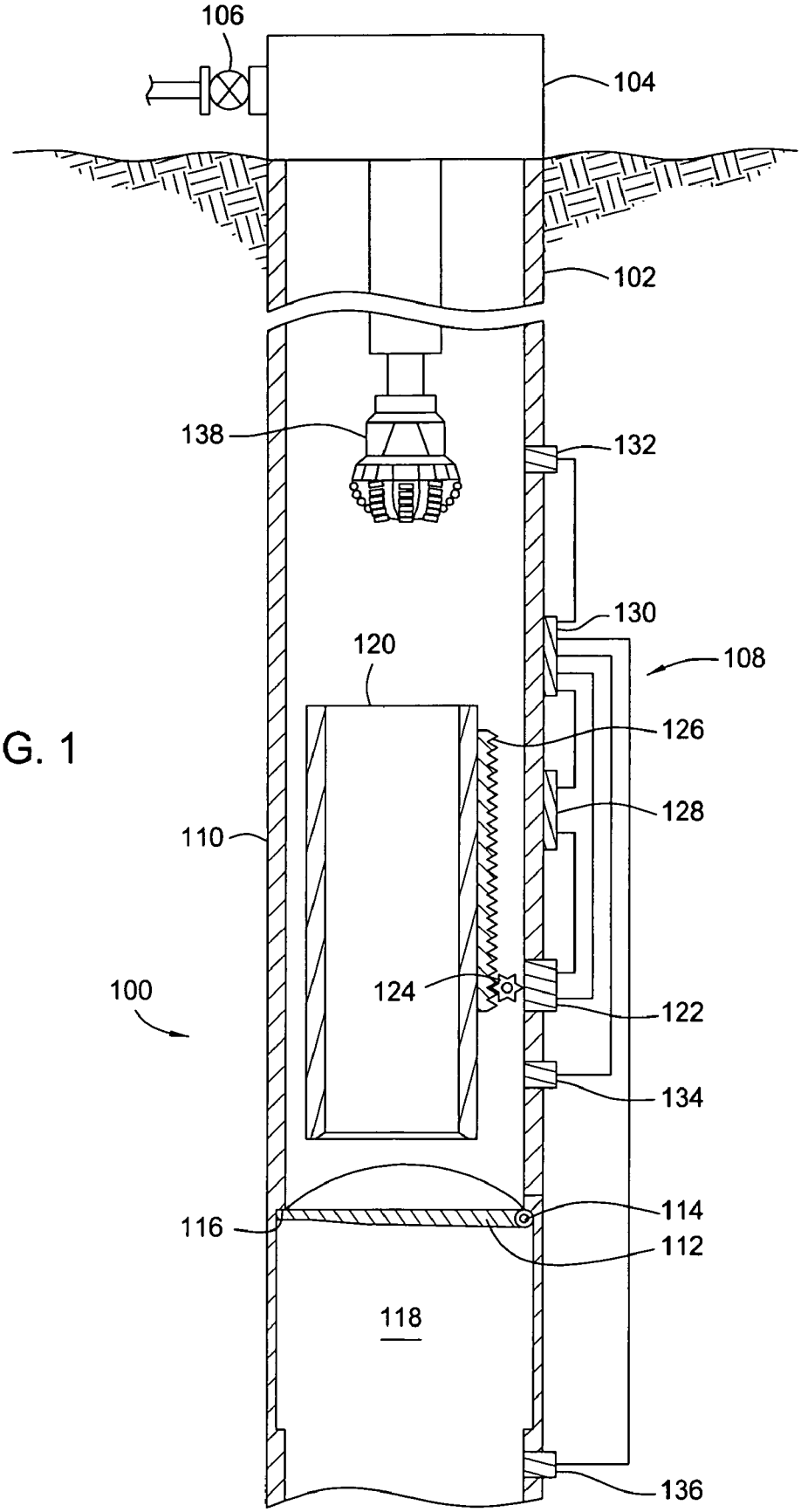
FIG. 1 is a partial section view of a downhole deployment valve (DDV) with an electrically operated actuation and sensor system self contained downhole that utilizes a rack and pinion arrangement for opening and closing the DDV.

FIG. 1 illustrates a downhole deployment valve (DDV) 100 within a casing string 102 disposed in a wellbore. The casing string 102 extends from a surface of the wellbore where a wellhead 104 would typically be located along with some type of valve assembly 106 which controls the flow of fluid from the wellbore and is schematically shown. The DDV 100 includes an electrically operated actuation and sensor system 108 self contained downhole, a housing 110, a flapper 112 having a hinge 114 at one end, and a valve seat 116 in an inner diameter of the housing 110 adjacent the flapper 112. Arrangement of the flapper 112 allows it to close in an upward fashion wherein a biasing member (not shown) and pressure in a lower portion 118 of the wellbore act to keep the flapper 112 in a closed position, as shown in FIG. 1. Axial movement of an inner sleeve 120 across the flapper 112 pushes the flapper 112 to an open position when desired.

The axial movement of the inner sleeve 120 can be accomplished by the actuation and sensor system 108. The actuation and sensor system 108 includes an electric motor 122 that drives a pinion 124 engaged with a rack 126 coupled along a length of the inner sleeve 120. Thus, rotation of the pinion 124 causes axial movement of the inner sleeve 120. Depending on the direction of the axial movement, the inner sleeve 120 either pushes the flapper 112 to the open position or displaces away from the flapper 112 to permit the flapper 112 to move to the closed position. A power pack 128 located downhole can provide the necessary power to the motor 122 such that electric lines to the surface are not required. The power pack 128 can utilize batteries or be based on inductive charge.

Additionally, the actuation and sensor system 108 includes a monitoring and control unit 130 with logic for controlling the actuation of the motor 122. The monitoring and control unit 130 can be located downhole and powered by the power pack 128 such that no control lines to the surface are required. In operation, the monitoring and control unit 130 detects signals from sensors that indicate when operation of the DDV 100 should occur in order to appropriately control the motor 122. For example, the monitoring and control unit 130 can receive signals from a drill string detection sensor 132 located uphole from the DDV 100, a first pressure sensor 134 located uphole of the flapper 112 and a second pressure sensor 136 located downhole of the flapper 112. The logic of the monitoring and control unit 130 only operates the motor 122 to move the inner sleeve 120 and thereby move the DDV 100 to the open position when a drill string 138 is detected and pressure across the flapper 112 is equalized. Until the sensors 132, 134, 136 indicate that these conditions have been met, the monitoring and control unit 130 does not actuate the motor 122 such that the DDV 100 remains in the closed position. Therefore, the actuation and sensor system 108 makes operation of the DDV 100 fully automatic while providing a safety interlock.

Figure 2:
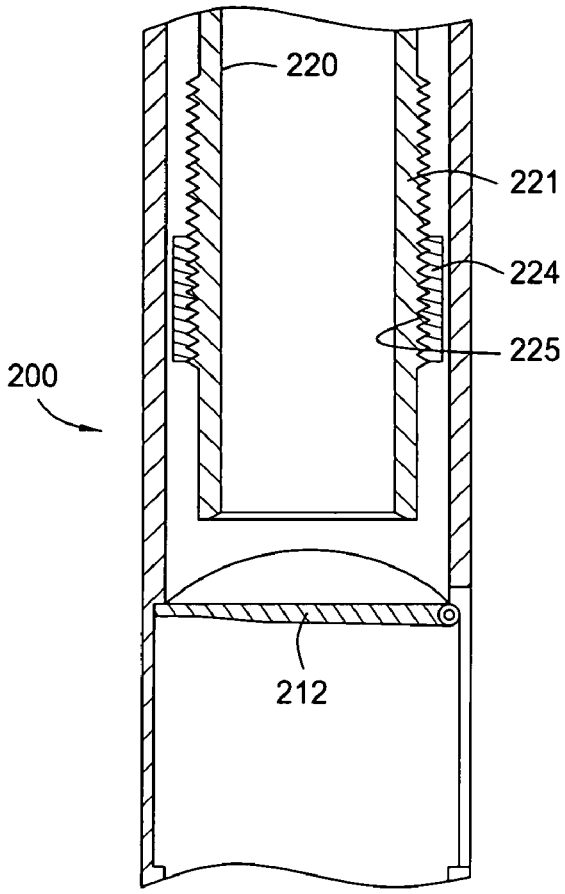
FIG. 2 is a section view of a DDV with an electrically operated actuation assembly that includes an axially stationary and rotatable nut to move an inner sleeve engaged therein for opening and closing the DDV.

FIG. 2 shows a DDV 200 with an alternative embodiment for an electrically operated actuation assembly that includes an axially stationary and rotatable nut 224 to move an inner sleeve 220 engaged therein. Threads 225 along an inside surface of the nut 224 mate with corresponding threads 221 along an outside length of the inner sleeve 220. Thus, rotation of the nut 224 by an electric motor (not shown) causes the inner sleeve 220 to move axially in cooperation with a flapper 212 for moving the DDV between open and closed positions. Like all the electrical actuation assemblies described herein, this actuation assembly may be controlled via a conductive control line to the surface or an actuation and sensor system as described above.

Figure 3:
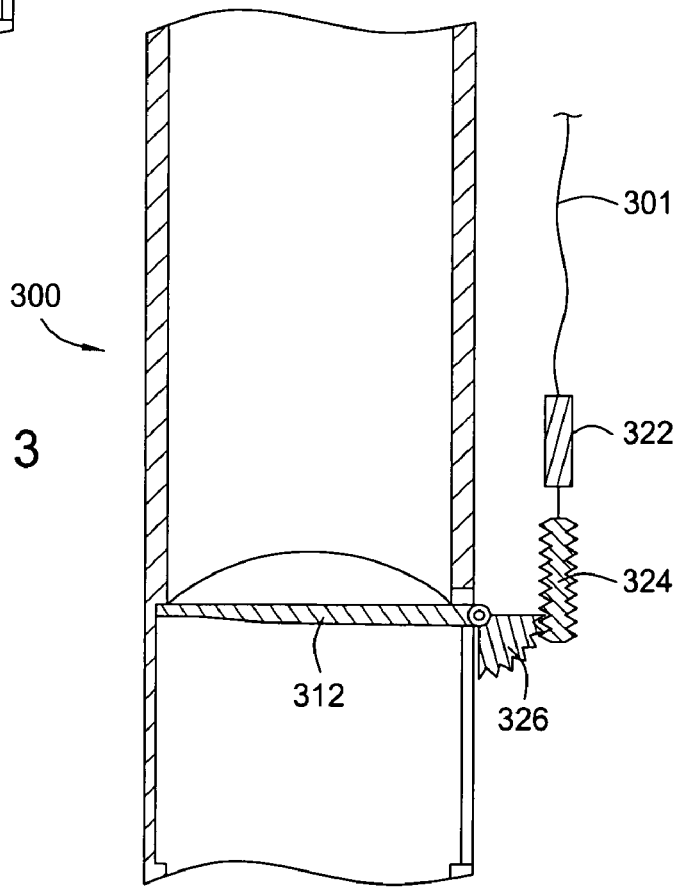
FIG. 3 is a section view of a DDV with an electrically operated actuation assembly that includes a worm gear connected to a motor for driving a gear hinge of a valve member for opening and closing the DDV.

FIG. 3 illustrates a DDV 300 with another alternative embodiment for an electrically operated actuation assembly that includes a worm gear 324 connected to a motor 322 for driving a gear hinge 326 of a valve member, such as flapper 312. Rotation of the worm gear 324 rotates the flapper 312 to move the DDV 300 between open and closed positions. The worm gear 324 can be used to further aid in maintaining the flapper 312 in the closed position since the worm gear 324 can be designed such that the gear hinge 326 cannot drive the worm gear 324. Again, a control line 301 to the motor 322 may be coupled either to the surface or an actuation and sensor system located downhole.

Figure 4:
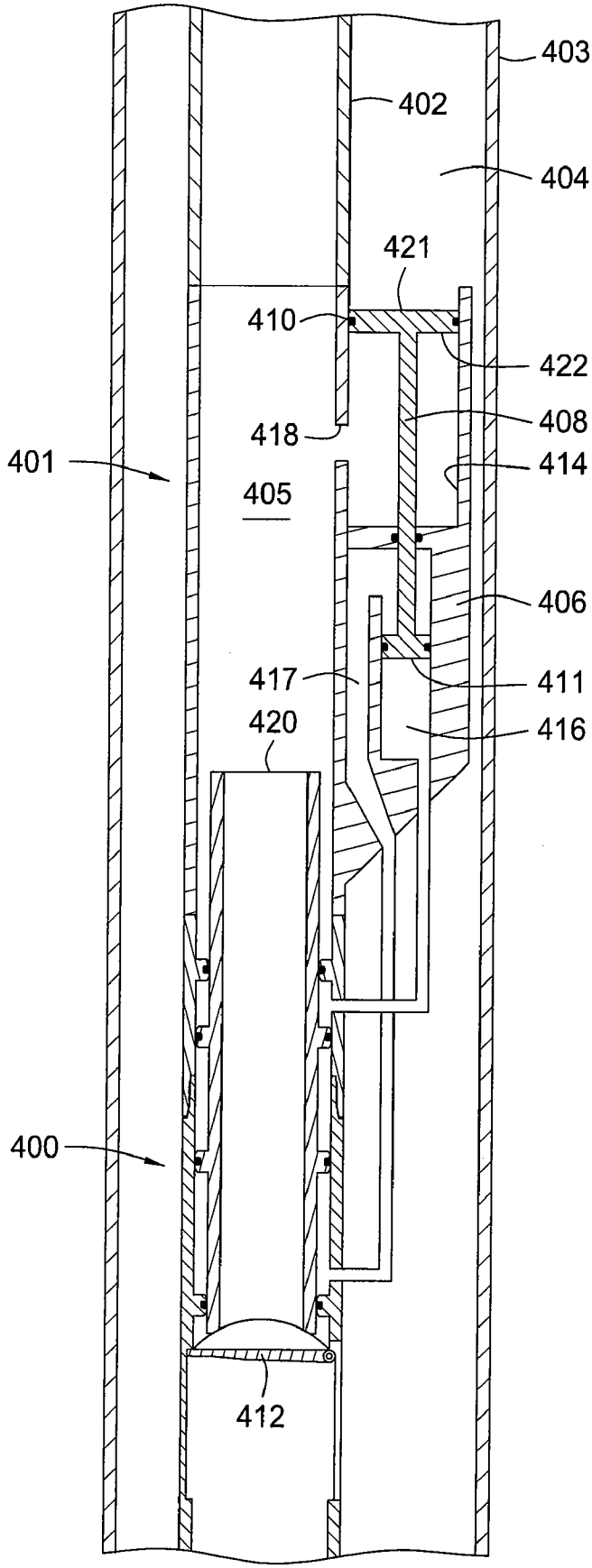
FIG. 4 is a section view of a DDV having an annular pressure operated actuation assembly showing the DDV in a closed position.

FIG. 4 shows a DDV 400 having an annular pressure operated actuation assembly 401 that is illustrated relatively enlarged to reveal operation thereof. A casing string 402 having the DDV 400 therein is disposed concentrically within an outer casing string 403 to form an annular area 404 therebetween. The annular pressure operated actuation assembly 401 may be used to control a downhole tool such as the DDV 400 that would otherwise require a hydraulic control line connected to the surface for actuation. Consequently, the DDV 400 can be a separate component such as a currently available DDV designed for actuation using hydraulic control lines. Alternatively, the DDV 400 can be integral with the annular pressure operated actuation assembly 401.

The annular pressure operated actuation assembly 401 includes a body 406 and a piston member 408 having a first end 410 disposed within an actuation cylinder 414 and a second end 411 separating an opening chamber 416 from a closing chamber 417. Pressure within bore 405 enters the actuation cylinder 414 through port 418 and acts on a back side 422 of the first end 410 of the piston member 408. However, pressure within the annulus 404 acts on a front side 421 of the first end 410 of the piston member 408 such that movement of the piston member 408 is based on these counter acting forces caused by the pressure differential. Therefore, pressure within the bore 405 is greater than pressure within the annulus 404 when the piston member 408 is in a first position, as shown in FIG. 4. In this first position, fluid is forced from the closing chamber 417 since the volume therein is at its minimum while the opening chamber 416 is able to receive fluid since the volume therein is at its maximum. The fluid forced from the closing chamber 417 acts on an inner sleeve 420 of the DDV 400 and displaces the inner sleeve 420 away from a flapper 412 to permit the flapper 412 to close.

Figure 5:
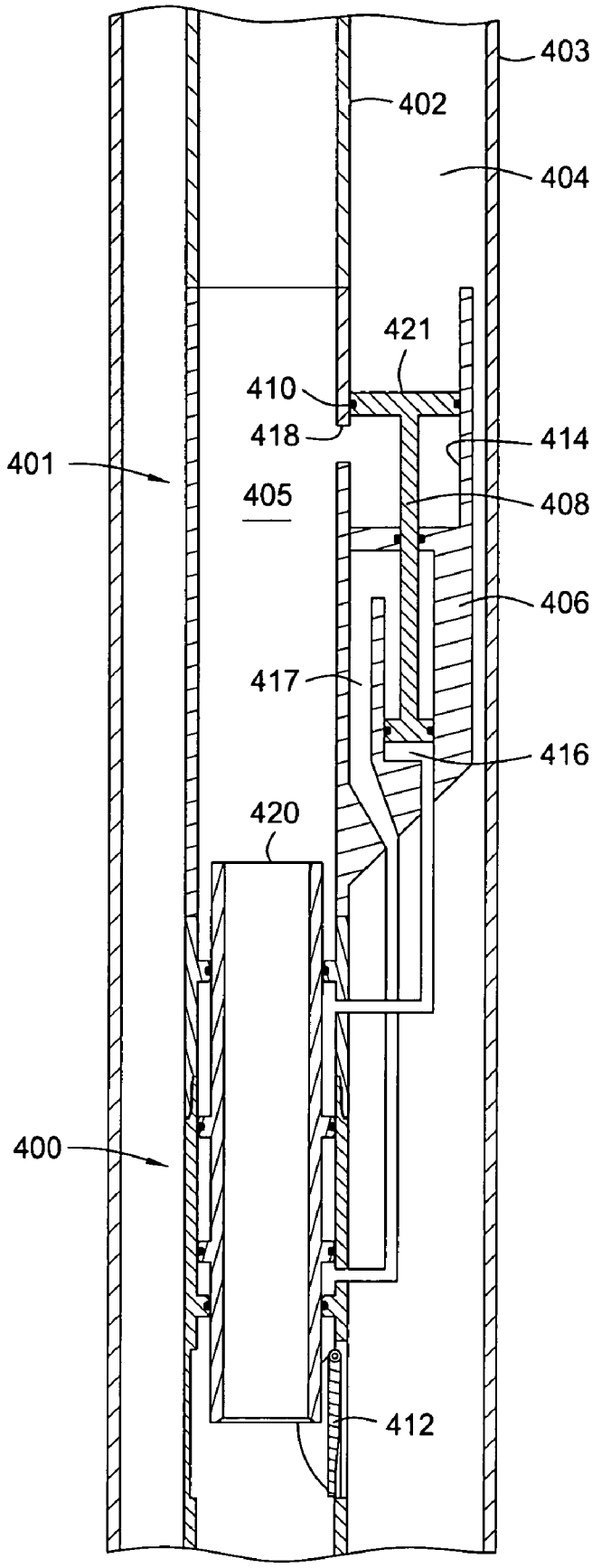
FIG. 5 is a section view of the DDV and annular pressure operated actuation assembly in FIG. 4 illustrating the DDV in an open position.

FIG. 5 illustrates the DDV 400 and the annular pressure operated actuation assembly 401 in FIG. 4 with the DDV 400 in an open position. In operation, fluid pressure is increased in the annulus 404 until the pressure in the annulus 404 is greater than the pressure in the bore 405. At this point, the piston member 408 moves to a second position and forces fluid from the opening chamber 416. The fluid forced from the opening chamber 416 acts on the inner sleeve 420 of the DDV 400 and displaces the inner sleeve 420 across the flapper 412 causing the flapper 412 to open. In order to not require that pressure be maintained in the annulus 404 in order to hold the DDV 400 open, the sleeve 420 can have a locking mechanism to maintain the position of the DDV 400 such as described in U.S. Pat. No. 6,209,663, which is herein incorporated by reference.

For some embodiments, the actuation cylinder 414 does not include the port 418 to the bore 405. Rather, a pre-charge is established in the actuation cylinder 414 to counter act pressures in the annulus 404. The pre-charge is selected based on any hydrostatic pressure in the annulus 404.

Figure 6:
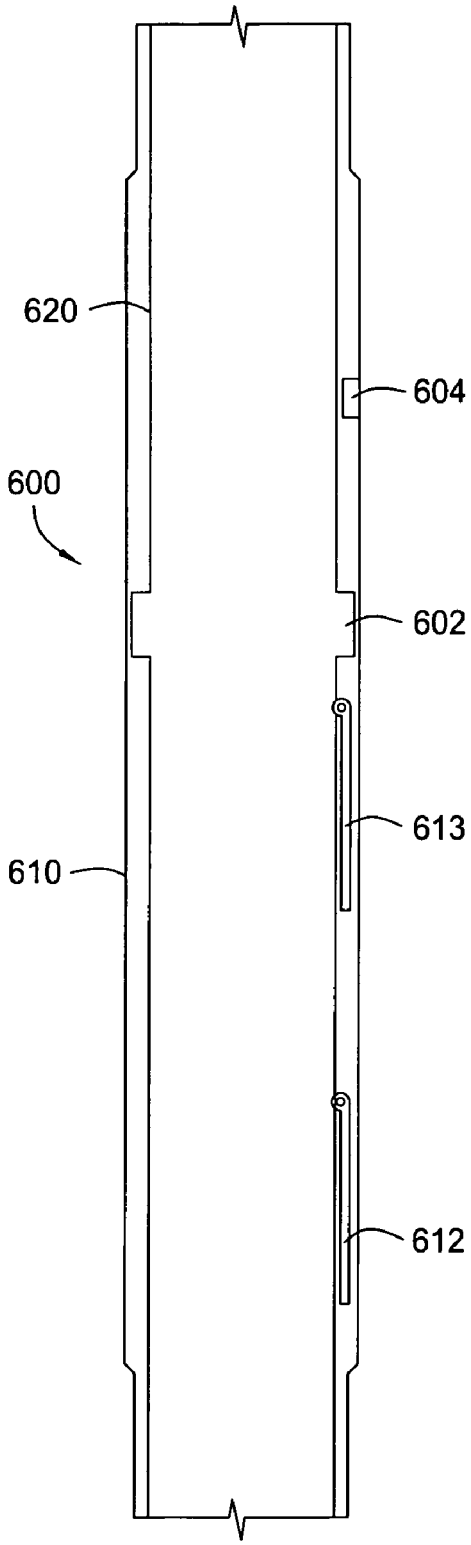
FIG. 6 is a section view of a DDV having a primary valve member and a back-up valve member and shown in an open position.

FIG. 6 shows a DDV 600 in an open position and having a primary valve member 612 and a back-up valve member 613. In the embodiment shown, the primary and back-up valve members 612, 613 are flappers held open by an axially movable inner sleeve 620 that is displaced to interferingly prevent the valve members 612, 613 from closing.

Figure 7:
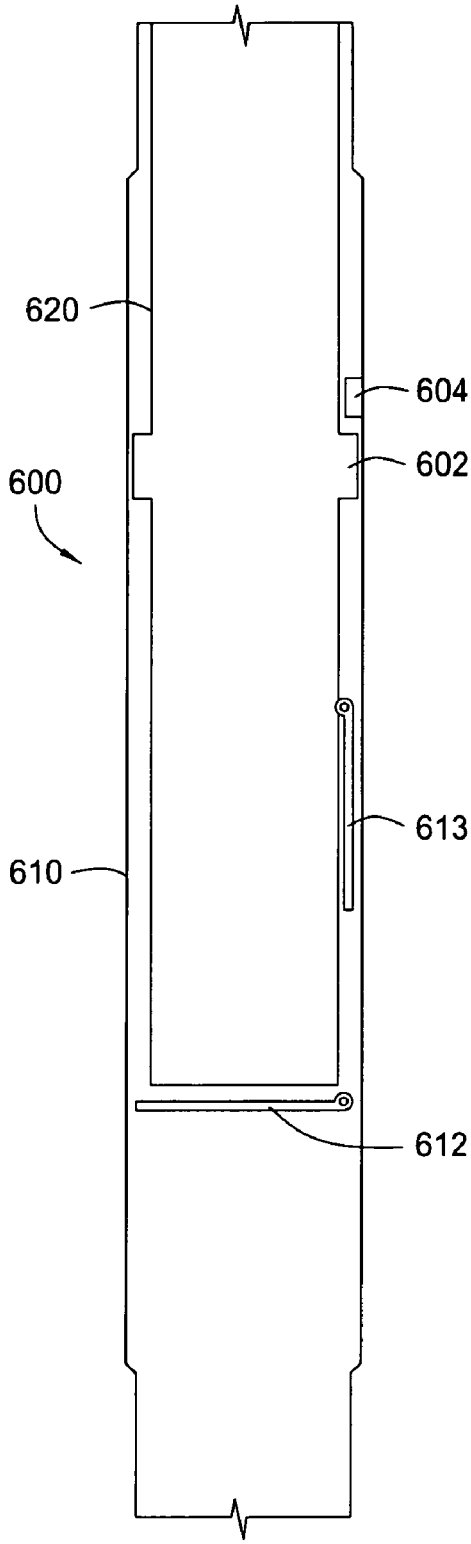
FIG. 7 is a section view of the DDV in FIG. 6 shown in a normal closed position with only the primary valve member closed.

FIG. 7 illustrates the DDV 600 in FIG. 6 with the inner sleeve 620 retracted to permit the primary valve member 612 to close and place the DDV 600 in a normal closed position. A stop 604 along an inside surface of a housing 610 of the DDV 600 contacts a shoulder 602 of the inner sleeve 620 that has an enlarged outside diameter. The stop 604 interferes and prevents further axial movement of the inner sleeve 620. Thus, the inner sleeve 620 continues to interfere with the back-up valve member 613 and prevent the back-up valve member 613 from closing during normal operation of the DDV 600. However, applying a predetermined additional force (e.g., increased hydraulic pressure for embodiments where the inner sleeve is hydraulically actuated) to the inner sleeve 620 overcomes the stop 604, which can be made from a shearable or otherwise retractable member. With the back-up valve member 613 always open to permit passage therethrough during normal operation of the DDV 600, a dropped object will not damage the back-up valve member 613 regardless of whether the DDV 600 is in the open position or the normal closed position.

Figure 8:
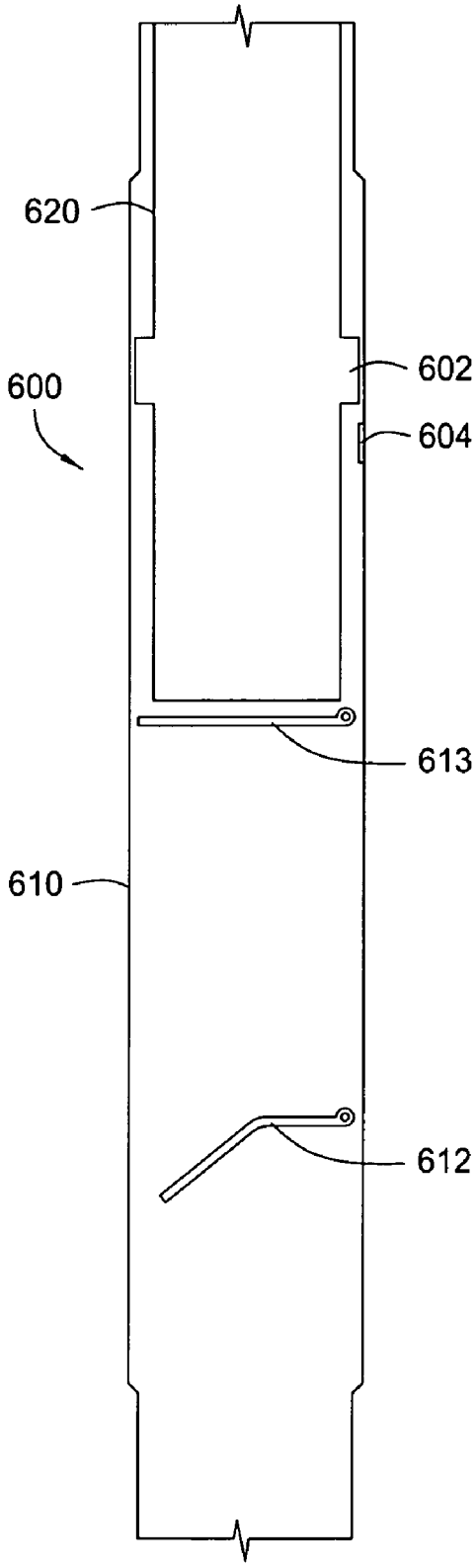
FIG. 8 is a section view of the DDV in FIG. 6 shown in a back-up closed position with the back-up valve member activated since the integrity of the primary valve member is compromised.

FIG. 8 shows the DDV 600 in FIG. 6 in a back-up closed position after the predetermined additional force is applied to the inner sleeve 620 to enable continued axial displacement of the inner sleeve 620. The additional movement of the inner sleeve 620 displaces the inner sleeve 620 away from the back-up valve member 613 enabling the back-up valve member 613 to close. While the integrity of the primary valve member 612 is compromised, the DDV 600 in the back-up closed position can maintain safe operation.

Figure 9:
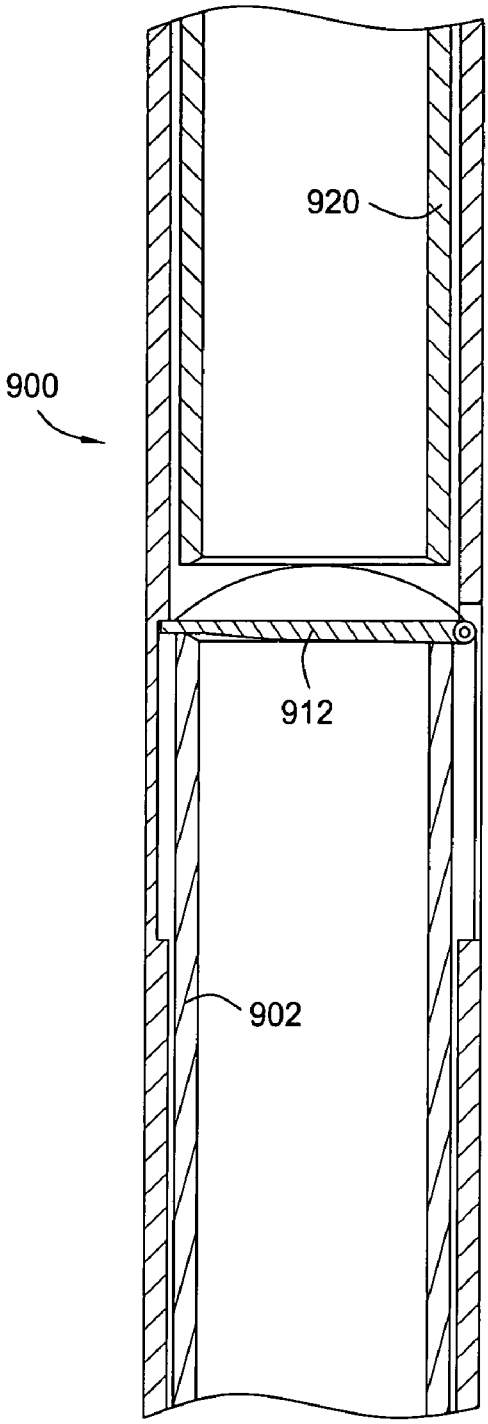
FIG. 9 is a section view of a DDV with an axially moveable lower support sleeve in a backstop position for aiding in maintaining a valve member closed.

FIG. 9 illustrates a DDV 900 with an axially moveable lower support sleeve 902 in a backstop position for aiding in maintaining a valve member such as flapper 912 closed when the DDV 900 is in a closed position. In the backstop position, an end of the support sleeve 902 contacts a perimeter of the flapper 912. The support sleeve 902 can include a locking feature as discussed above that maintains the support sleeve 902 in the backstop position without requiring continual actuation. With the support sleeve 902 providing additional support for the flapper 912, the flapper 912 is not limited by a biasing member and/or pressure in the bore below the flapper to ensure that the flapper stays closed. Thus, the flapper 912 can support additional weight such as from a shock attenuating material (e.g., sand, fluid, water, foam or polystyrene balls) disposed on the flapper 912 without permitting the shock attenuating material to leak thereacross.

Figure 10:
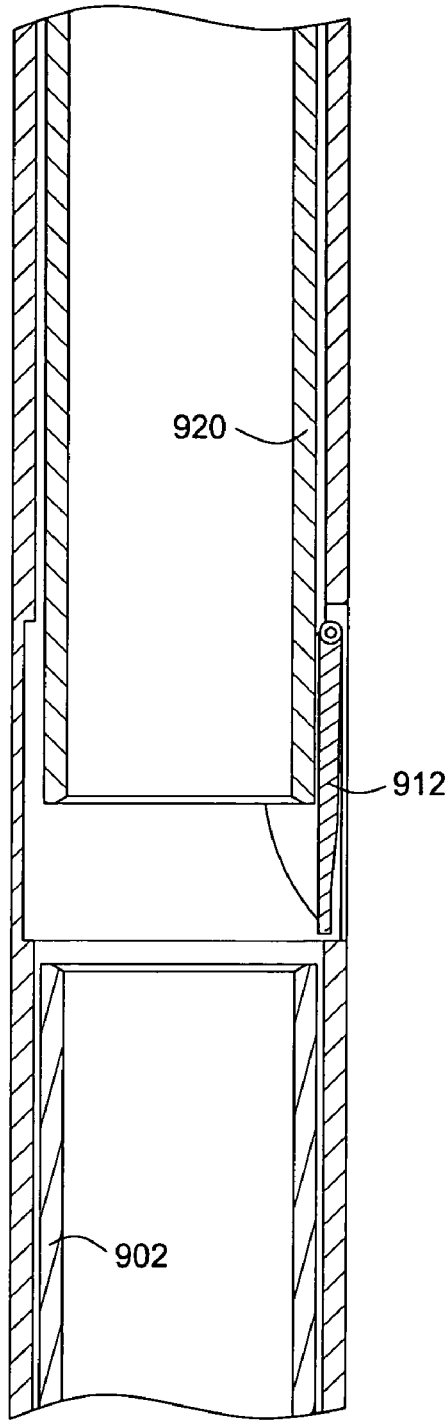
FIG. 10 is a section view of the DDV in FIG. 9 with the axially moveable lower support sleeve in a retracted position to permit movement of the valve member.

FIG. 10 shows the DDV 900 in FIG. 9 with the axially moveable lower support sleeve 902 in a retracted position to permit movement of the flapper 912 as an inner sleeve 920 moves through the flapper 912 to place the DDV 900 in an open position. The movement of the support sleeve 902 can occur simultaneously or independently from the movement of the inner sleeve 920. Additionally, any electrical or hydraulic actuation mechanism such as those described herein may be used to move the support sleeve 902.

Figure 11:
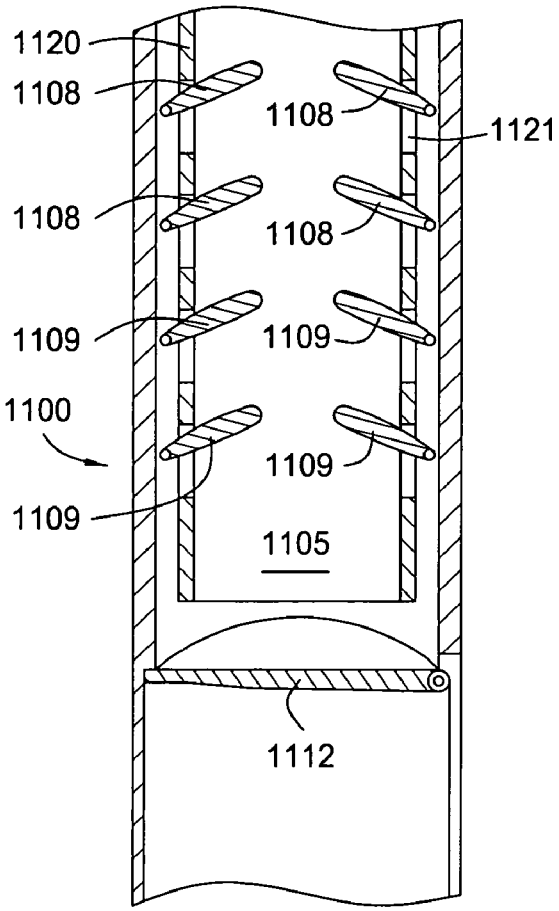
FIG. 11 is a section view of a DDV in a closed position with attenuation members extended into a central bore of the DDV for absorbing impact from a dropped object.

FIG. 11 illustrates a DDV 1100 in a closed position with attenuation members 1108, 1109 extended into a central bore 1105 of the DDV 1100 for absorbing impact from a dropped object (not shown). In the extended position, the inside diameter of the bore 1105 at the attenuation members 1108, 1109 is less than the outside diameter of the dropped object. In general, the attenuation members 1108, 1109 are any member capable of decreasing an impact of the dropped object by increasing the amount of time that it takes for the dropped object to stop. By decreasing the impact, the dropped object can possibly be saved and the potential for catastrophic damage is reduced. The axial length of the bore 1105 that the attenuation members 1108, 1109 span is of sufficient length to absorb the impact of the dropped object to a point where the pressure integrity of a valve member 1112 is not compromised. Preferably, the attenuation members 1108, 1109 catch the dropped object prior to the dropped object reaching the valve member 1112 of the DDV 1100.

Examples of suitable attenuation members 1108, 1109 include axial ribs, inflated elements or flaps that deploy into the bore 1105. The attenuation members 1108, 1109 can absorb kinetic energy from the dropped object by bending, breaking, collapsing or otherwise deforming upon impact. In operation, a first section of the attenuation members (e.g., attenuation members 1108) contact the dropped object without completely stopping the dropped object, and a subsequent section of the attenuation members (e.g., attenuation members 1109) thereafter further slow and preferably stop the dropped object.

Any actuator may be used to move the attenuation members 1108, 1109 between extended and retracted positions. Further, either the same actuator used to move the attenuation members 1108, 1109 between the extended and retracted positions or an independent actuator may be used to actuate the DDV 1100. As shown in FIG. 11, an inner sleeve 1120 used to open and close the valve member 1112 may be used to move the attenuation members 1108, 1109 to the extended position by alignment of windows 1121 in the inner sleeve 1120 with the attenuation members 1108, 1109, which can be biased toward the extended position.

Figure 12:
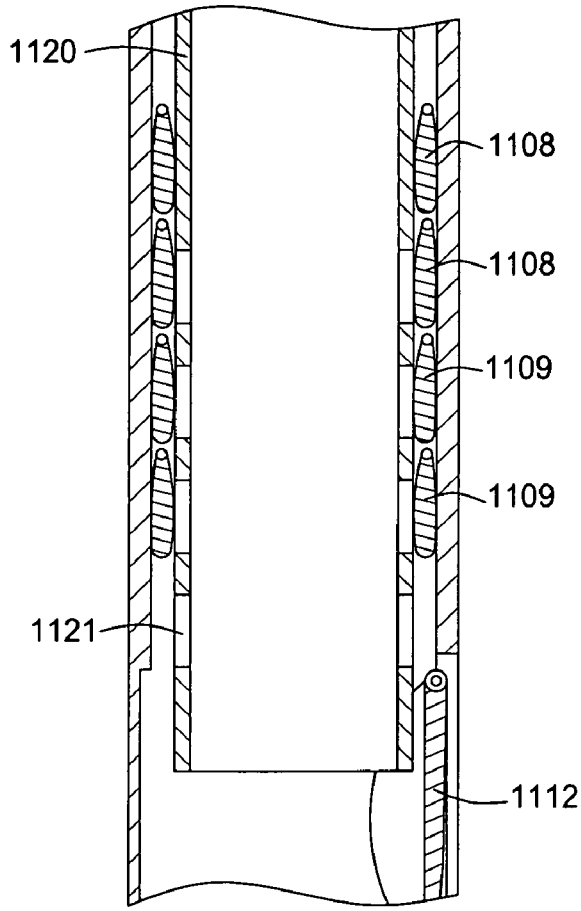
FIG. 12 is a section view of the DDV in FIG. 11 shown in an open position with the attenuation members retracted from the central bore of the DDV for enabling passage therethrough.

FIG. 12 shows the DDV 1100 in FIG. 11 in an open position with the attenuation members 1108, 1109 retracted from the central bore 1105 of the DDV 1100 for enabling passage therethrough. In the retracted position, the inner diameter of the bore 1105 at the attenuation members 1108, 1109 is sufficiently larger than the outer diameter of a tool string (not shown) such that the tool string can pass through the attenuation members 1108, 1109.

Figure 13:
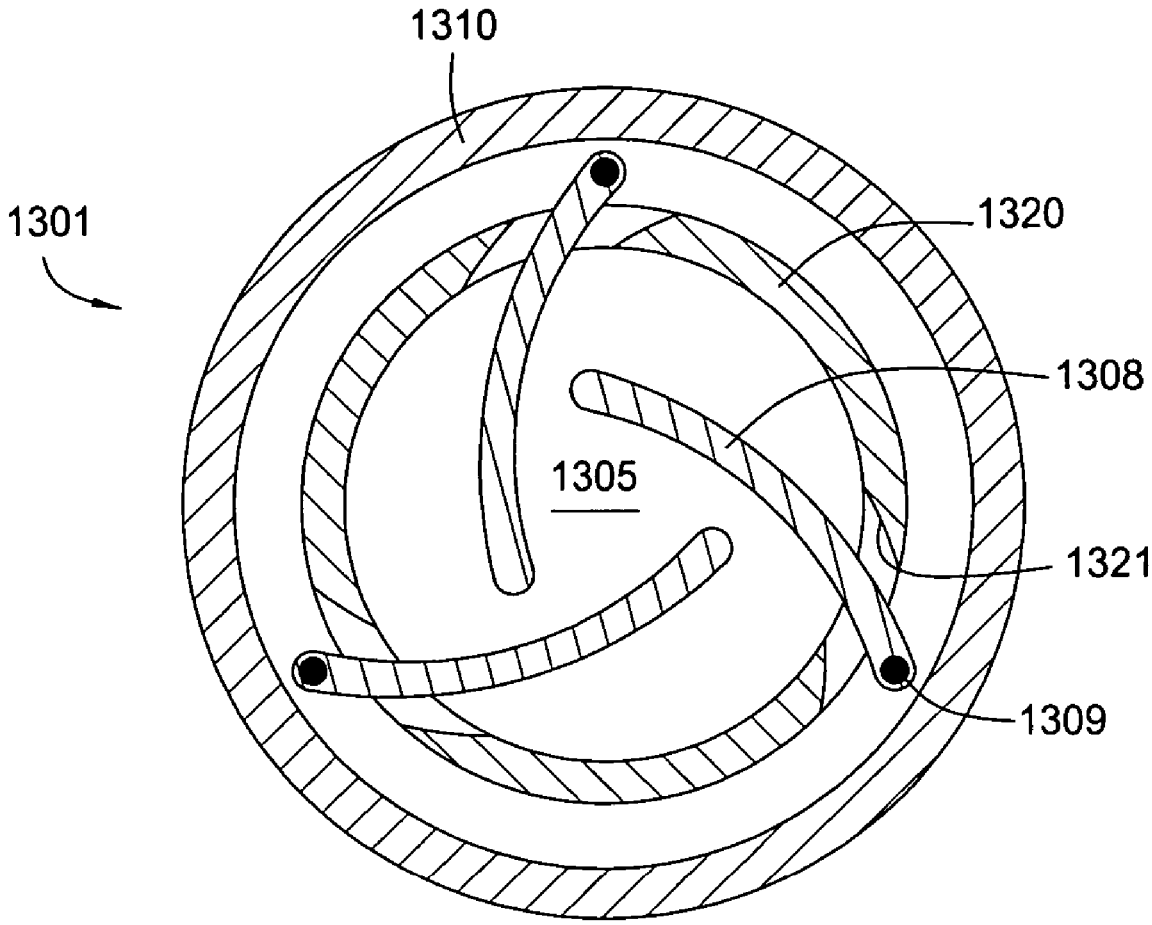
FIG. 13 is a cross-section view of an attenuation assembly for use with a DDV to absorb impact from a dropped object.

FIG. 13 illustrates an attenuation assembly 1301 for use with a DDV to absorb impact from a dropped object. The attenuation assembly 1301 includes attenuation members 1308 that extend into a bore 1305 of the attenuation assembly 1301 and span an axial length of the attenuation assembly 1301 similar to the attenuation members 1108, 1109 shown in FIGS. 11 and 12. In this embodiment, the attenuation members 1308 couple to a housing 1310 by hinges 1309 and are actuated between the extended and retracted positions by rotation of an inner sleeve 1320.

Figure 14:
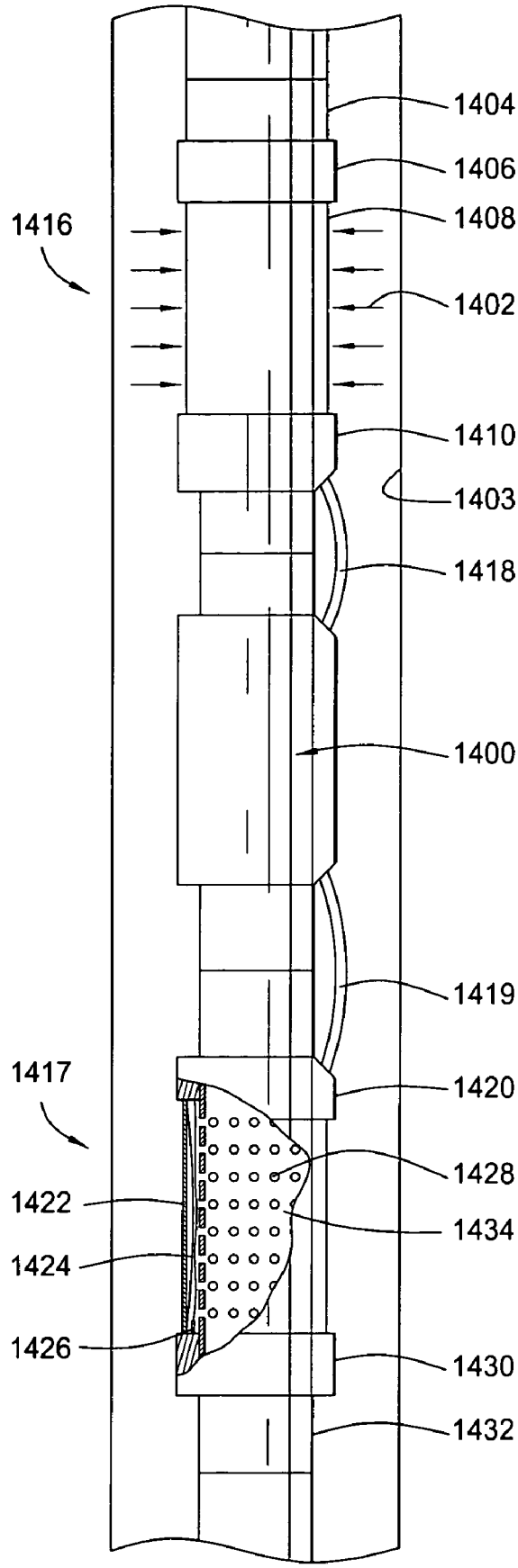
FIG. 14 is a view of a DDV positioned in a bore and coupled to coordinating upper and lower bladder assemblies used to actuate the DDV.

FIG. 14 illustrates a DDV 1400 positioned in a bore 1403 and coupled to an upper bladder assembly 1416 and a lower bladder assembly 1417 that are used cooperatively to actuate the DDV 1400 between open and closed positions. The upper bladder assembly 1416 responds to annular pressure indicated by arrows 1402 in order to supply pressurized fluid to the DDV 1400. However, the lower bladder assembly 1417 responds to bore pressure in order to supply pressurized fluid to the DDV 1400. The DDV 1400 actuates based on which one of the bladder assemblies 1416, 1417 is alternately supplying more fluid pressure to the DDV 1400 than the other bladder assembly as determined by the pressure differential between the bore and the annulus. Accordingly, the DDV 1400 may be similar in design to the DDV 400 shown in FIG. 4. For example, fluid pressure supplied from the upper bladder assembly 1416 through an upper hydraulic line 1418 opens the DDV 1400, and fluid pressure supplied from the lower bladder assembly 1417 through a lower hydraulic line 1419 closes the DDV 1400. For some embodiments, the actuation of the DDV 1400 may be reversed such that fluid pressures supplied from the upper and lower bladder assemblies 1416, 1417 respectively close and open the DDV 1400. Furthermore, the bladder assemblies 1416, 1417 may be arranged in any position relative to one another and the DDV 1400.

The upper bladder assembly 1416 includes a bladder element 1408 disposed between first and second rings 1406, 1410 spaced from each other on a solid base pipe 1404. An elastomer material may form the bladder element 1408, which can optionally be biased against a predetermined force caused by the annular pressure 1402. For some embodiments, the first ring 1406 slides along the base pipe 1404 to further enable compression and expansion of the bladder element 1408. In operation, increasing the annular pressure 1402 to a predetermined level compresses the bladder element 1408 against the base pipe 1404 to force fluid contained by the bladder element 1408 to the DDV 1400.

The lower bladder assembly 1417 includes a bladder element 1426, a biasing band 1424 that biases the bladder element 1426 against a predetermined force caused by the bore pressure, and an outer shroud 1422 that are all disposed between first and second rings 1420, 1430 spaced from each other on a perforated base pipe 1404. The pressure in a bore 1434 of the bladder assembly 1417 acts on a surface of the bladder element 1426 due to apertures 1428 in the perforated base pipe that also aid in protecting the bladder element 1426 from damage as tools pass through the bore 1434. In operation, increasing the pressure in the bore 1434 to a predetermined level compresses the bladder element 1426 against the outer shroud 1422 to force fluid contained by the bladder element 1426 to the DDV 1400. The length of the bladder elements 1408, 1426 depends on the pressures that the bladder elements 1408, 1426 experience along with the amount of compression that can be achieved.

Figure 15:
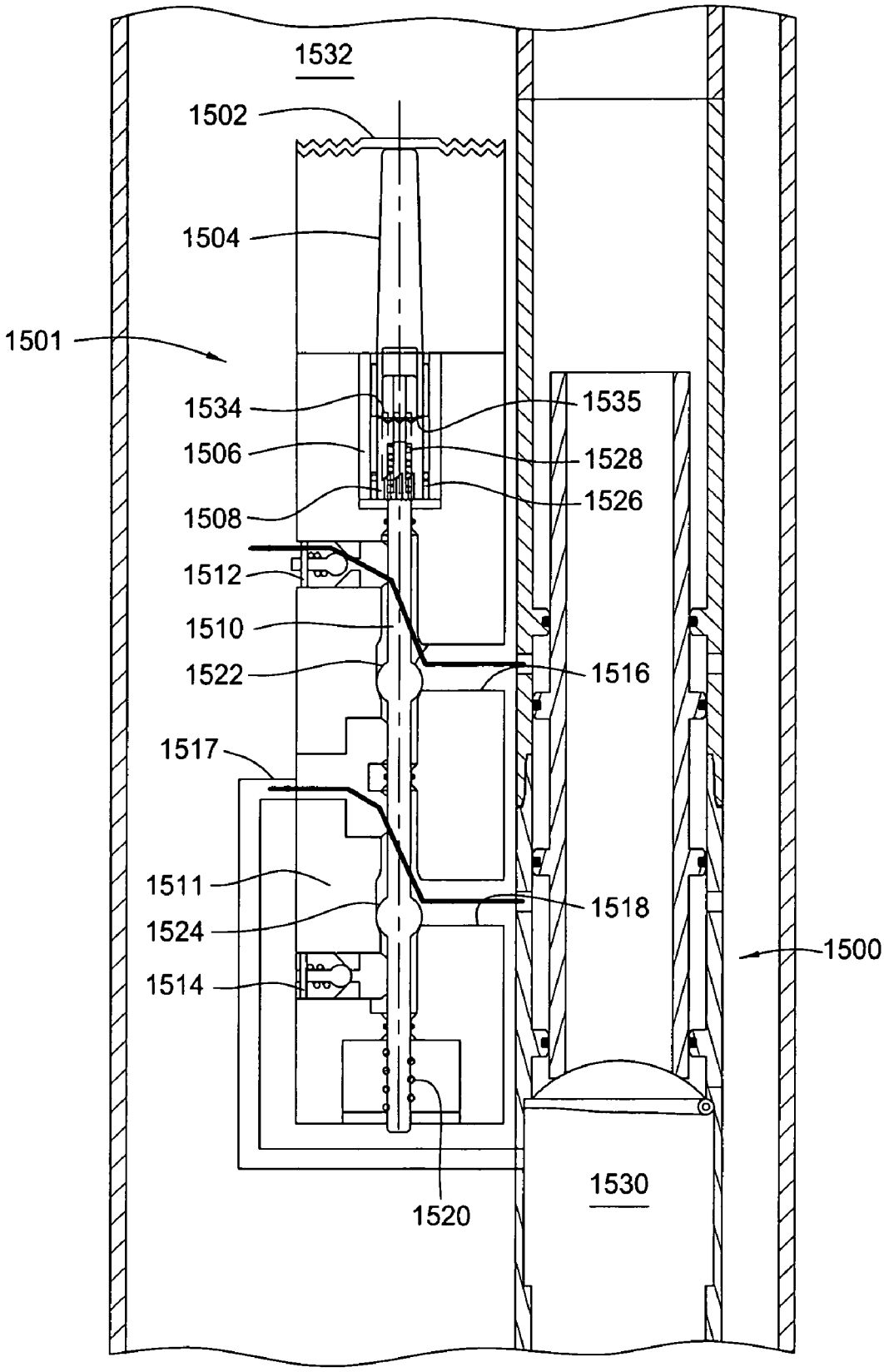
FIG. 15 is a section view of an annular pressure operated actuation assembly shown in a first position to actuate a DDV to a closed position.

FIG. 15 shows an annular pressure operated actuation assembly 1501 (illustrated schematically and relatively enlarged to reveal operation thereof) in a first position to actuate a DDV 1500 to a closed position. The actuation assembly 1501 includes a diaphragm 1502, an input shaft 1504, a j-sleeve 1506, an index sleeve 1508, and a valve member 1510 within a valve body 1511 for selectively directing flow through first and second check valves 1512, 1514 and selectively directing flow from a bore pressure port 1517 to first and second ports 1516, 1518 of the valve body 1511. This selective directing of flow of pressurized fluid to and from the DDV 1500 coupled to the first and second ports 1516, 1518 of the actuation assembly 1501 controls actuation of the DDV 1500. The actuation assembly 1501 may control various other types of valves such as a sliding sleeve valve or a rotating ball valve to regulate flow of pressurized fluid to the DDV 1500. Axial position of the index sleeve 1508 within the actuation assembly 1501 determines the axial position of the valve member 1510, which directs flow through the valve body 1511 by blocking and opening flow paths with first and second ball portions 1522, 1524 of the valve member 1510.

The j-sleeve 1506 includes a plurality of grooves around an inner circumference thereof that alternate between short and long. The grooves interact with corresponding profiles 1526 along an outer base of the index sleeve 1508. Accordingly, the index sleeve 1508 is located in one of the short grooves of the j-sleeve 1506 while the actuating assembly 1501 is in the first position. While a lower biasing member 1520 biases the valve member 1510 upward, the lower biasing member 1520 does not overcome the force supplied by an upper biasing member 1528 urging the valve member 1510 downward. Thus, the upper biasing member 1528 maintains the ball portions 1522,

1524 against their respective seats due to the index sleeve 1508 being in the short groove of the j-sleeve 1506 such that the upper biasing member 1528 is not completely extended as occurs when the index sleeve 1508 is in the long grooves of the j-sleeve 1506. In the first position of the actuation assembly 1501, pressurized fluid from the bore 1530 passes through the second port 1518 to the DDV 1500 as fluid received at the first port 1516 from the DDV 1500 vents through check valve 1512 in order to close the DDV 1500.

Figure 16:
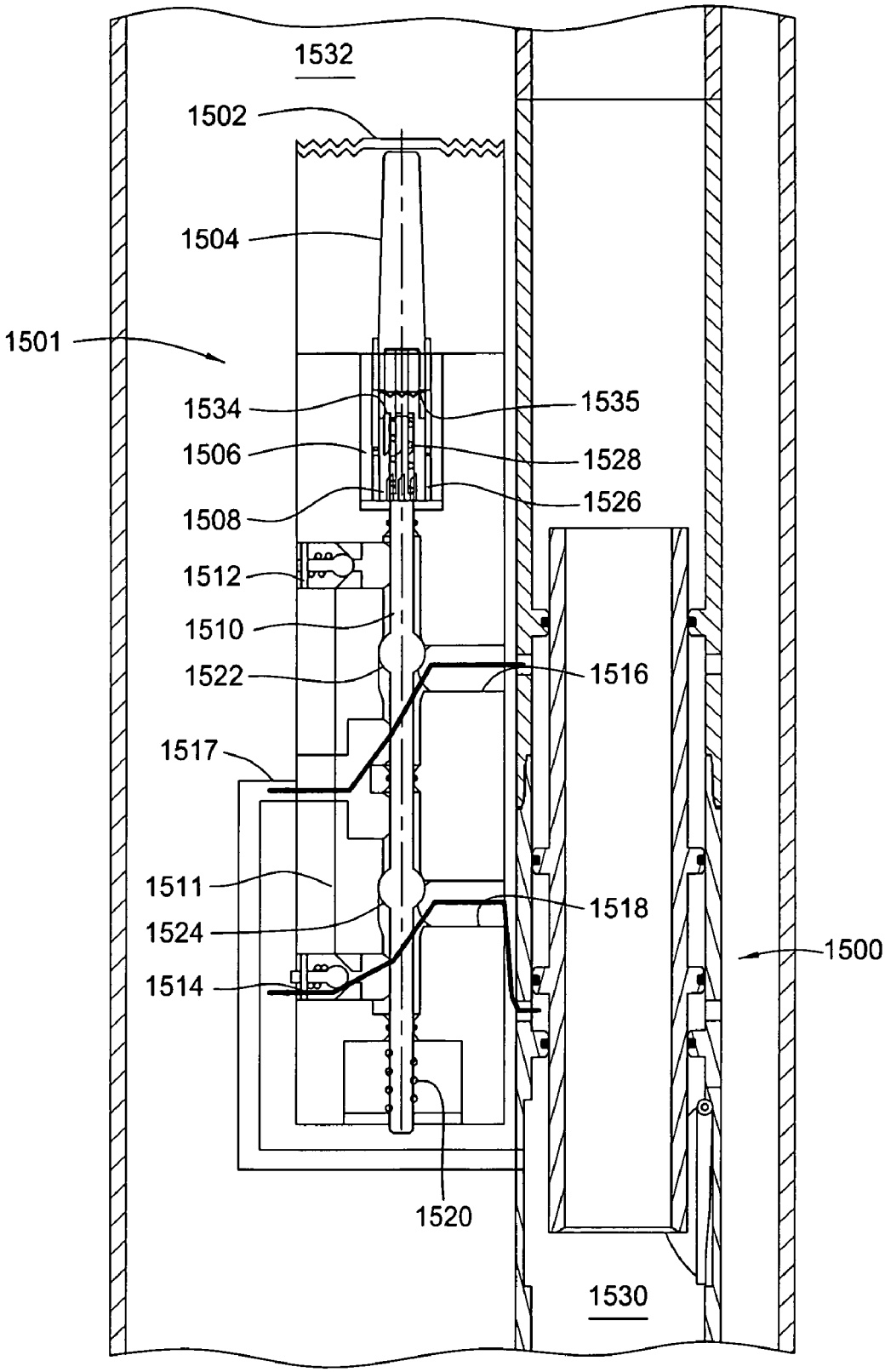
FIG. 16 is a section view of the annular pressure operated actuation assembly in FIG. 15 shown in a second position to actuate a DDV to an open position.

FIG. 16 illustrates the actuation assembly 1501 shown in a second position to actuate the DDV 1500 to an open position. In operation, fluid pressure in the annulus 1532 is increased to operate the actuation assembly 1501. Pressure in the annulus 1532 acts on the diaphragm 1502 to move the input shaft 1504 down. A bottom end of the input shaft 1504 defines teeth 1535 corresponding to mating teeth 1534 along an upper shoulder of the index sleeve 1508. The teeth 1535 of the input shaft 1504 merely contact the mating teeth 1534 of the index sleeve 1508 without fully mating rotationally until the profiles 1526 of the index sleeve have disengaged from the grooves of the j-sleeve 1506 upon the input shaft 1504 axial displacing the index sleeve 1508 relative to the j-sleeve 1506. Once the profiles 1526 on the index sleeve 1508 disengage from the j-sleeve 1506, the teeth 1535 on the input shaft 1504 are allowed to fully engage the mating teeth 1534 of the index sleeve 1508 causing the index sleeve 1508 to rotate. The input shaft 1504 moves up when pressure is relieved against the diaphragm 1502. The profiles 1526 of the index sleeve 1508 then contact the j-sleeve 1506 causing the index sleeve 1508 to rotate into an adjacent set of the grooves in the j-sleeve 1506. Since the adjacent set of grooves in the j-sleeve 1506 are long, the raised axial location of the index sleeve 1508 enables the valve member 1510 that is biased upward to move upward and redirect flow through the valve body 1511. Additionally, the rotation of the index sleeve 1508 causes the mating teeth 1534 of the index sleeve 1508 to disengage from the teeth 1535 of the input shaft 1504 such that the actuation assembly 1501 is reset to cycle again and place the actuation assembly 1501 back to the first position. In the second position of the actuation assembly 1501, pressurized fluid from the bore 1530 passes through the first port 1516 while fluid received at the second port 1518 vents through check valve 1512 in order to open the DDV 1500.

A shock attenuating material such as sand, fluid, water, foam or polystyrene balls may be placed above the DDV in combination with any aspect of the invention. For example, placing a water or fluid column above the DDV cushions the impact of the dropped object.

Any of the features, characteristics, alternatives or modifications described regarding a particular embodiment herein may also be applied, used, or incorporated with any other embodiment described herein. While the foregoing is directed to embodiments of the present invention, other and further embodiments of the invention may be devised without departing from the basic scope thereof, and the scope thereof is determined by the claims that follow.

The invention claimed is:

1. A downhole deployment valve (DDV), comprising:

a housing disposed in a wellbore and defining a bore adapted for passage of tools therethrough;

a valve member disposed within the housing and movable between an open position and a closed position, wherein the valve member substantially seals a first portion of the bore from a second portion of the bore in the closed position;

a drill string detection sensor proximate the valve member for sensing a presence of a drill string; and a monitoring and control unit (MCU) proximate the housing for automatically opening and closing the valve member based on signals from the sensor.

2. The DDV of claim 1, further comprising at least one selectively extendable attenuation member to at least partially obstruct the bore when in an extended position for decreasing the velocity of an object falling toward the valve member prior to the object contacting the primary valve member.

3. The DDV of claim 2, further comprising a common actuator for opening and closing the valve member and extending and retracting the at least one selectively extendable attenuation member.

4. The DDV of claim 1, further comprising:

a first pressure sensor in communication with the first bore portion, and a second pressure sensor in communication with the second bore portion.

5. The DDV of claim 4, wherein the monitoring and control unit includes logic that only opens the valve member when signals from the pressure sensors indicate an equalized pressure differential and a signal from the drill string sensor indicates the presence of a drill string.

6. The DDV of claim 1, further comprising a downhole power source for supplying power to the monitoring and control unit and an actuator coupled to the valve member.

7. The DDV of claim 1, further comprising an actuator in communication with the MCU and operably coupled to the valve member, the actuator comprising a motor.

8. The DDV of claim 7, wherein:

the valve member is a flapper, the DDV further comprises a sleeve axially movable in the housing, and the actuator is operable to move the sleeve between the open position where the sleeve holds the flapper open and the closed position where the sleeve is moved away from the flapper.

9. The DDV of claim 8, further comprising a rack coupled along a length of the sleeve and a pinion engaged with the rack and operably coupled to the motor.

10. The DDV of claim 8, wherein threads are formed along an outer surface of the sleeve and the DDV further comprises a nut engaged with the threads, the nut operably coupled to the motor.

11. The DDV of claim 7, wherein:

the valve member is a flapper, the DDV further comprises:

a gear hinge rotationally coupled to the flapper, and p2 a worm gear engaged with the gear hinge and operably coupled to the motor.

12. The DDV of claim 1, wherein the valve member is a flapper or a ball.

13. The DDV of claim 8, wherein:

a window is formed through a wall of the sleeve, and the DDV further comprises an attenuation member (AM) extending through the window when the sleeve is in the closed position and held in an annulus defined between the sleeve and the housing when the sleeve is in the open position.

14. The DDV of claim 8, further comprising a second flapper.

15. The DDV of claim 8, further comprising a second sleeve movable to support the flapper in the closed position.

16. The DDV of claim 15, further comprising shock attenuating material disposed on the flapper.

17. A method of drilling a wellbore, comprising:

assembling a downhole deployment valve (DDV) as part of a casing string, the DDV comprising:

a housing defining a bore therethrough in communication with a bore of the casing string, and a valve member disposed in the housing and moveable between an open position and a closed position, wherein the valve member substantially seals a first portion of the casing bore from a second portion of the casing bore in the closed position;

running the casing string and the DDV into the wellbore;

running a drill string into the wellbore and through the casing string bore, the drill string comprising a drill bit disposed at an axial end thereof;

automatically opening the valve member in response to the drill bit being proximate to the DDV.

18. The method of claim 17, wherein the DDV further comprises a first pressure sensor in communication with the first portion of the casing bore and a second pressure sensor in communication with the second portion of the casing bore.

19. The method of claim 18, wherein automatically opening the valve member is further in response to a pressure in the first portion of the casing bore being equal to a pressure in the second portion of the casing bore.

20. The method of claim 17, wherein the DDV further comprises:

a drill string detection sensor, an actuator operably coupled to the valve member, and a monitoring and control unit (MCU) in communication with the sensor and the actuator, wherein the automatic opening is caused by the MCU operating the actuator.

21. The method of claim 17, wherein:

the casing string extends from a wellhead located at a surface of the wellbore, the wellhead comprises a rotating drilling head (RDH) and a valve assembly, and the method further comprises:

engaging the RDH with the drill string; and drilling the wellbore using the valve assembly to control flow of fluid from the wellbore.

22. The method of claim 21, wherein the wellbore is drilled in an underbalanced or near underbalanced condition.

23. The method of claim 21, further comprising:

retracting the drill string to a location above the DDV;

closing the DDV;

depressurizing the upper portion of the tubular string bore; and removing the drill string from the wellbore.

24. The method of claim 17, wherein the valve member is a flapper or a ball.

25. The method of claim 17, wherein at least portion of the casing string is cemented to the wellbore.

26. The method of claim 25, wherein the DDV and the casing string are cemented to the wellbore.

27. The method of claim 17, wherein the casing string is a tie-back casing string.

28. A downhole deployment valve (DDV), comprising:

a housing disposed in a wellbore and defining a bore adapted for passage of tools therethrough;

a valve member disposed within the housing and movable between an open position and a closed position, wherein the valve member substantially seals a first portion of the bore from a second portion of the bore in the closed position;

at least one sensor proximate the valve member for sensing a wellbore parameter, the at least one sensor comprising:

a first pressure sensor in communication with the first bore portion, a second pressure sensor in communication with the second bore portion, and a tool sensor in communication with the first bore portion; and a monitoring and control unit (MCU) proximate the housing for automatically opening and closing the valve member based on signals from the at least one sensor, wherein the monitoring and control unit includes logic that only opens the valve member when signals from the pressure sensors indicate an equalized pressure differential and a signal from the tool sensor indicates the presence of a tool.

29. A downhole deployment valve (DDV), comprising:

a housing disposed in a wellbore and defining a bore adapted for passage of tools therethrough;

a sleeve axially movable in the housing;

a flapper disposed within the housing and movable between an open position and a closed position, wherein the flapper substantially seals a first portion of the bore from a second portion of the bore in the closed position;

at least one sensor proximate the valve member for sensing a wellbore parameter;

a monitoring and control unit (MCU) proximate the housing for automatically opening and closing the valve member based on signals from the at least one sensor; and an actuator:

in communication with the MCU, operably coupled to the valve member, comprising a motor, and operable to move the sleeve between the open position where the sleeve holds the flapper open and the closed position where the sleeve is moved away from the flapper.

30. The DDV of claim 29, further comprising a rack coupled along a length of the sleeve and a pinion engaged with the rack and operably coupled to the motor.

31. The DDV of claim 29, wherein threads are formed along an outer surface of the sleeve and the DDV further comprises a nut engaged with the threads, the nut operably coupled to the motor.

32. A down hole deployment valve (DDV), comprising:

a housing disposed in a wellbore and defining a bore adapted for passage of tools therethrough;

a flapper disposed within the housing and movable between an open position and a closed position, wherein the flapper substantially seals a first portion of the bore from a second portion of the bore in the closed position;

at least one sensor proximate the valve member for sensing a wellbore parameter;

a monitoring and control unit (MCU) proximate the housing for automatically opening and closing the valve member based on signals from the at least one sensor;

an actuator in communication with the MCU and operably coupled to the valve member, the actuator comprising a motor;

a gear hinge rotationally coupled to the flapper, and a worm gear engaged with the gear hinge and operably coupled to the motor.

33. A downhole deployment valve (DDV), comprising:

a housing disposed in a wellbore and defining a bore adapted for passage of tools therethrough;

a valve member disposed within the housing and movable between an open position and a closed position, wherein the valve member substantially seals a first portion of the bore from a second portion of the bore in the closed position;

a tool sensor in communication with the first bore portion, the tool sensor operable to detect a tool within the first bore portion; and a monitoring and control unit (MCU) in communication with the tool sensor and operable to automatically open the valve member in response to detection of the tool.

34. The DDV of claim 33, further comprising:

a first pressure sensor in communication with the first bore portion and the MCU; and a second pressure sensor in communication with the second bore portion and the MCU, wherein the MCU is operable to open the valve in response to the detection of the tool and equalization of the bore portions.

35. A method of drilling a wellbore, comprising:

running a drill string into the wellbore and through a bore of a casing string, the casing string comprising a valve member moveable between an open position and a closed position, wherein the valve member substantially seals a first portion of the casing bore from a second portion of the casing bore in the closed position;

automatically opening the valve member when the drill string is proximate to the valve member; and drilling the wellbore using the drill string.

36. The method of claim 35, further comprising:

retracting the drill string through the open valve member; and automatically closing the valve member when the drill string is retracted through the valve member.

* * * * *

UNITED STATES PATENT AND TRADEMARK OFFICE

CERTIFICATE OF CORRECTION

PATENT NO. : 7,451,809 B2
APPLICATION NO. : 11/157512
DATED : November 18, 2008
INVENTOR(S) : Noske et al.

It is certified that error appears in the above-identified patent and that said Letters Patent is hereby corrected as shown below:

Column 10, Claim 11, Line 47, please delete “p2”;

Column 12, Claim 32, Line 43, please delete “down hole” and insert --downhole--.

Signed and Sealed this

Thirty-first Day of March, 2009

JOHN DOLL
*Acting Director of the United States Patent and Trademark Office*